US006520154B2

(12) United States Patent
Lamb et al.

(10) Patent No.: US 6,520,154 B2
(45) **Date of Patent: *Feb. 18, 2003**

(54) SIDE FEED FUEL INJECTOR AND INTEGRATED FUEL RAIL/INTAKE MANIFOLD

(75) Inventors: Curtis D. Lamb, Scottsville, NY (US); Daniel F. Smith, Conesus, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/849,087

(22) Filed: May 4, 2001

(65) Prior Publication Data

US 2001/0025627 A1 Oct. 4, 2001

Related U.S. Application Data

(63) Continuation of application No. 09/248,410, filed on Feb. 11, 1999, now Pat. No. 6,260,537.
(60) Provisional application No. 60/075,611, filed on Feb. 20, 1998.

(51) Int. Cl.[7] ..... F02M 41/00

(52) U.S. Cl. ..... 123/456; 123/467
(58) Field of Search ..... 123/456, 447, 123/468, 469, 470, 471, 472, 184.47, 478, 184.21; 239/585.1; 251/129.01, 129.15

(56) References Cited

U.S. PATENT DOCUMENTS

| | | | | |
|---|---|---|---|---|
| 3,605,703 A | * | 9/1971 | Moulds | 123/478 |
| 3,913,537 A | * | 10/1975 | Ziesche et al. | 123/472 |
| 4,776,313 A | | 10/1988 | Freismuth et al. | |
| 4,966,120 A | * | 10/1990 | Itoh et al. | 123/516 |
| 5,044,563 A | * | 9/1991 | Mesenich | 239/585 |
| 5,058,555 A | | 10/1991 | Haboush, II et al. | |
| 5,070,844 A | | 12/1991 | Daly | |
| 5,163,406 A | | 11/1992 | Daly et al. | |

* cited by examiner

*Primary Examiner*—Willis R. Wolfe
*Assistant Examiner*—Mahmoud Gimie
(74) *Attorney, Agent, or Firm*—Patrick M. Griffin

(57) ABSTRACT

A fuel injector includes a body having a nozzle end and a connector end. The body defines a side feed opening disposed between said nozzle end and said connector end. An injection assembly is disposed in the nozzle end and includes an actuating coil, a value actuated by the coil, and a valve seat operably associated with the valve.

20 Claims, 8 Drawing Sheets

SIDE FEED FUEL INJECTOR AND INTEGRATED FUEL RAIL/INTAKE MANIFOLD

CROSS REFERENCE TO RELATED APPLICATIONS

This is a continuation of U.S. patent application Ser. No. 09/248,410, filed Feb. 11, 1999 now U.S. Pat. No. 6,260,537, which claims the benefit of U.S. Provisional Patent Application Ser. No. 60/075,611, filed Feb. 20, 1998.

TECHNICAL FIELD

This invention relates to a side feed fuel injector, and such a fuel injector in combination with an air intake manifold having an integrated fuel rail.

BACKGROUND OF THE INVENTION

It is known in the art relating to engine intake manifolds to provide a manifold assembly including a manifold having a plurality of air intake passages connected with a plenum and having injector pockets connecting with the air passages. Top feed fuel injectors secured in assembly with a separate fuel rail are received in the injector pockets for selectively delivering fuel to the air intake passages to create a combustible air fuel mixture for delivery to the cylinders of an associated engine. Side mounted electrical connectors provide for connection of the injectors to an actuating electric power source.

An alternative manifold assembly provides an internal common fuel passage that acts as a fuel rail connecting with a plurality of injector pockets. Bottom feed fuel injectors are secured in the injector pockets and receive fuel from the common fuel passage through bottom feed openings. The fuel enters the bottom feed injectors between injection valve seats at the nozzle end of the injectors and an actuating coil and armature which actuate the injection valve through an axially extending rod or needle valve.

The top feed fuel injection system has provided better performance than the bottom feed system which has led to wide usage of the top feed system in spite of the additional costs associated with the separate fuel rail and additional subassembly operations involved in its manufacture.

SUMMARY OF THE INVENTION

The present invention provides a side feed fuel injector.

The invention comprises, in one form thereof, a fuel injector including a body having a nozzle end and a connector end. The body defines a side feed opening disposed between said nozzle end and said connector end. An injection assembly is disposed in the nozzle end, and includes an actuating coil, a valve actuated by the coil, and a valve seat operably associated with the valve.

An advantage of the present invention is that the performance advantages of top feed fuel injection systems are provided while gaining the reduction in cost attributable to elimination of the separate fuel rail and subassembly.

These and other features and advantages of the invention will be more fully understood from the following description of certain specific embodiments of the invention taken together with the accompanying drawings.

BRIEF DESCRIPTION OF THE DRAWINGS

The above-mentioned and other features and advantages of this invention, and the manner of attaining them, will become appreciated and be more readily understood by reference to the following detailed description of one embodiment of the invention in conjunction with the accompanying drawings, wherein.

DESCRIPTION OF THE PREFERRED EMBODIMENT

Figure 1:
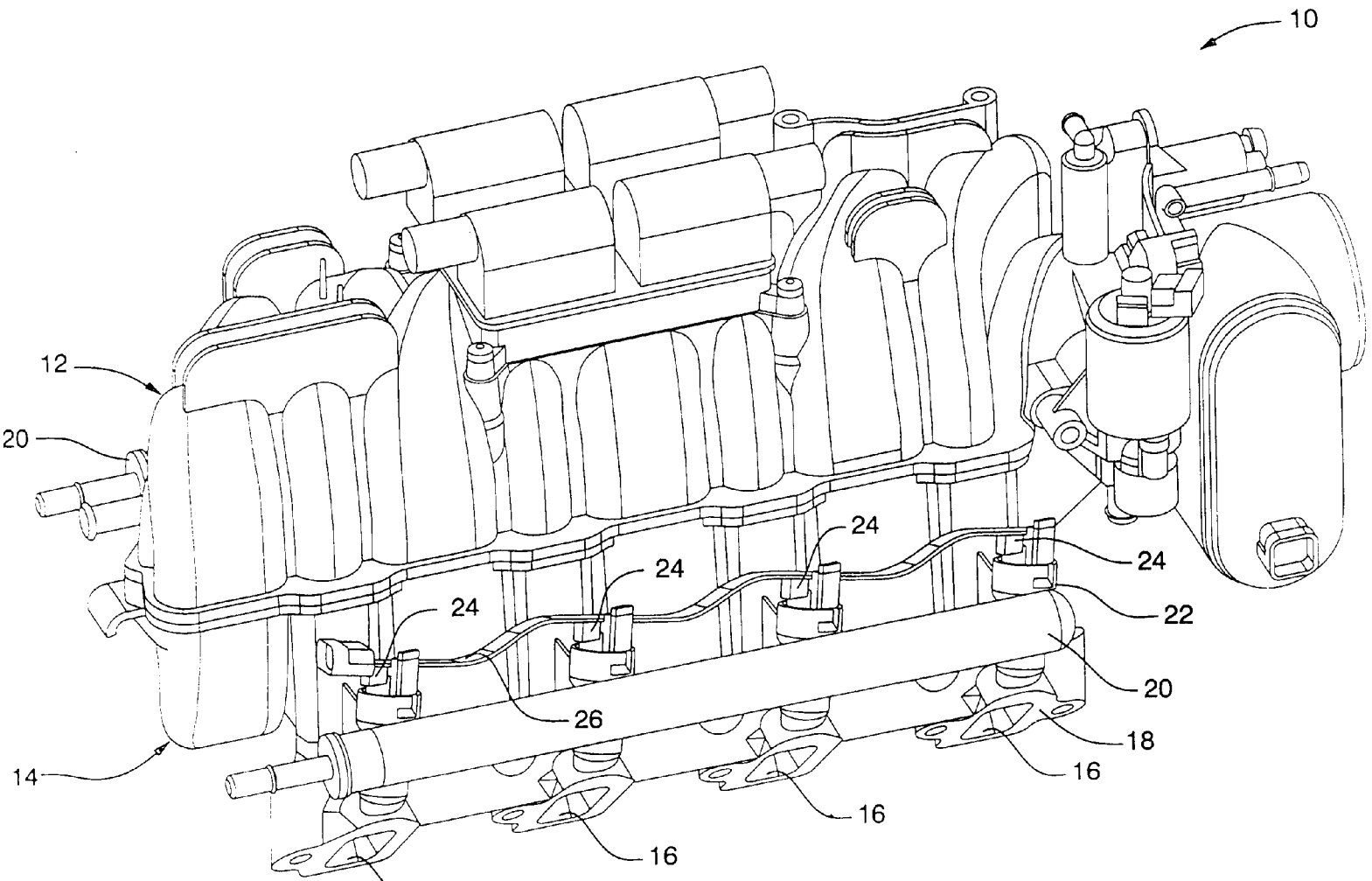
FIG. 1 is a complete intake manifold assembly including a manifold with an integrated fuel rail and side feed injectors in accordance with the invention.

Referring now to the drawings, and particularly to FIG. 1, one embodiment of an engine intake manifold assembly of the present invention is shown. Assembly 10 includes upper and lower sections 12 and 14, respectively, which internally define a plenum (not shown) that connects through individual runners with a plurality of air intake passages 16. Passages 16 extend to machined faces 18 on either side of the manifold and which are connectable with associated engine cylinder heads to thereby connect intake passages 16 with associated engine cylinder inlet ports (not shown). Along both sides of manifold assembly 10, there are formed integral fuel rails 20 that internally define common fuel passages which connect with a plurality of generally cylindrical pods 22 defining internal pockets, not shown. Within each of the pockets there is mounted a side feed fuel injector 24 formed in accordance with the invention. The injectors are electrically connected with a flexible connector 26 adapted for connection to an electrical power source for actuating the injectors.

Figure 2:
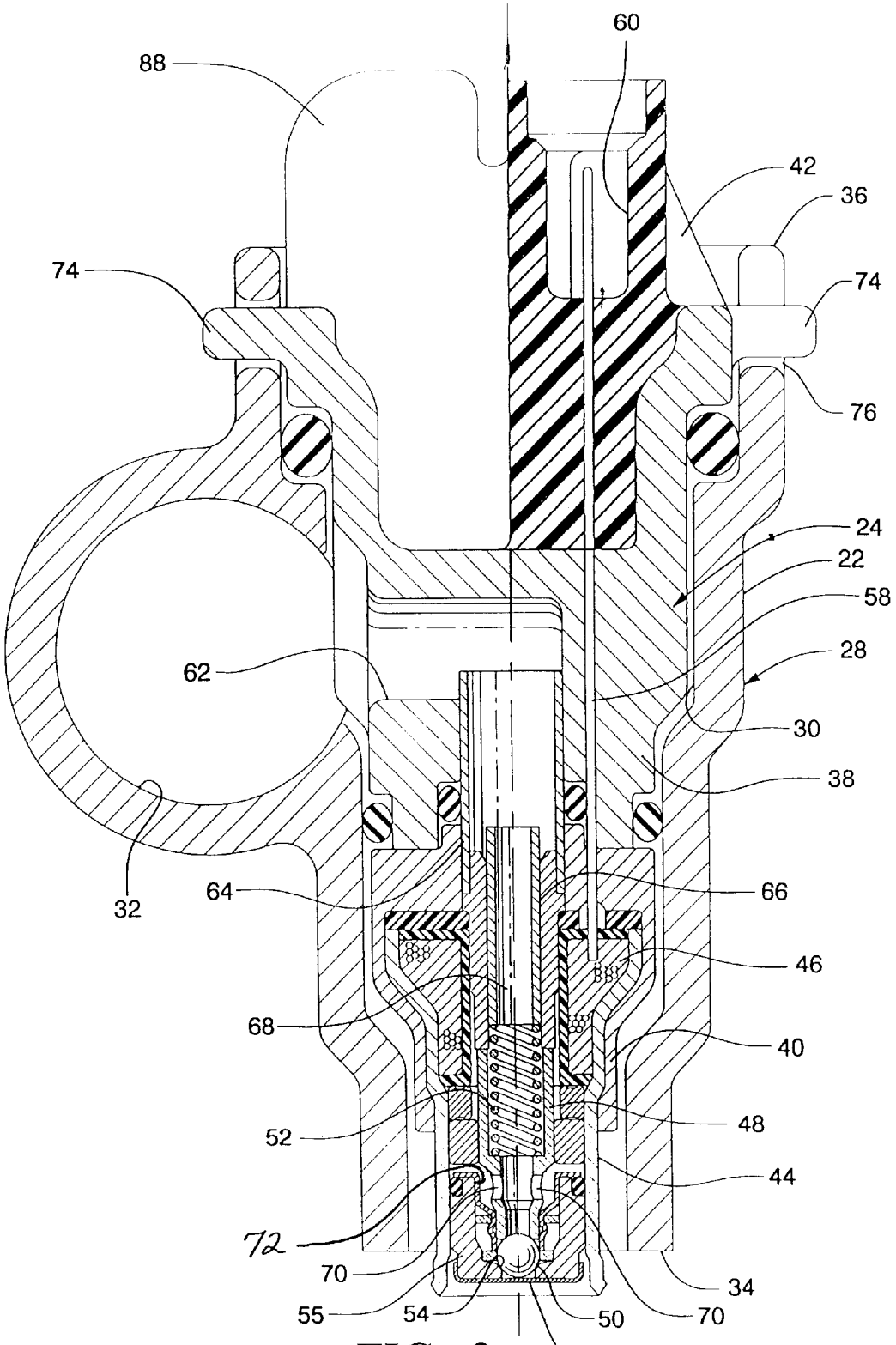
FIG. 2 is cross-sectional view showing the interior of a side feed injector according to the invention as mounted in an exemplary intake manifold assembly.

Referring now to FIG. 2, there is shown a portion of a manifold 28 including a pod 22 internally defining a drop-through injector pocket 30 in which a side feed fuel injector 24 is mounted. Manifold 28 further includes an integral common fuel passage 32 which performs the function of a fuel rail. Passage 32 communicates with the injector pocket 30 between the ends thereof, which include one end 34 that is adapted to communicate with a manifold air intake passage, not shown, and an opposite second end 36 through which the side feed fuel injector 24 is inserted or withdrawn.

Injector 24 includes a body 38, having a nozzle end 40 and a connector end 42. Injection assembly 44 is disposed within nozzle end 40 and includes electrical actuating coil 46, armature 48, injection valve 50, spring 52, valve seat 54, nozzle member 55 and orifice plate 56. Coil 46 is operable to actuate armature 48 connected with injection valve 50.

Spring 52 urges valve 50 against valve seat 54 for closing a nozzle opening or orifice in nozzle member 55. Orifice plate 56 on the end of the nozzle member 55 includes orifices, not shown, for atomizing fuel discharged through the nozzle opening. Actuating coil 46 connects through conductors 58, only one of which is shown, with a connector socket 60 on the connector end of body 38 for connecting coil 46 with an electrical power source.

Within injector body 38 is an internal fuel passageway including a side feed opening 62 that fluidly connects with an axially extending connector tube 64. Tube 64 fluidly communicates with an axially centered adjusting tube 66 that compresses spring 52 to a predetermined desired pre-load force. The tube 66, spring 52 and upper portions of the armature 48 and injection valve 50 define an axially centered central fuel passage 68 that extends through the coil 46 and armature 48 to openings 70 in the injection valve 50. From there, the fuel passageway continues outside the injection valve through a nozzle member 72 to the valve seat 54.

The location of the side feed opening 62 above the injection assembly 44 and passage 68, allows fuel to enter and pass through the injector with the same degree of efficiency and freedom of flow as in the corresponding top feed injectors. It should be particularly noted, however, that disposing the entire injection assembly 44 within nozzle end 40, i.e., at the lower end of the injector, minimizes the mass of the injection valve and connecting components to thereby improve the performance of fuel injector 24 over conventional bottom feed injectors.

It is noted that O-ring seals are utilized at various places within the injector and between the injector body and the associated injector pocket 30 in order to prevent any undesirable leakage of fuel within and from the assembly. In addition, the connector end 42 of the injector is provided with laterally extending lugs 74 which are engaged in L-shaped slots 76, as will be more particularly described hereinafter.

Figure 3:
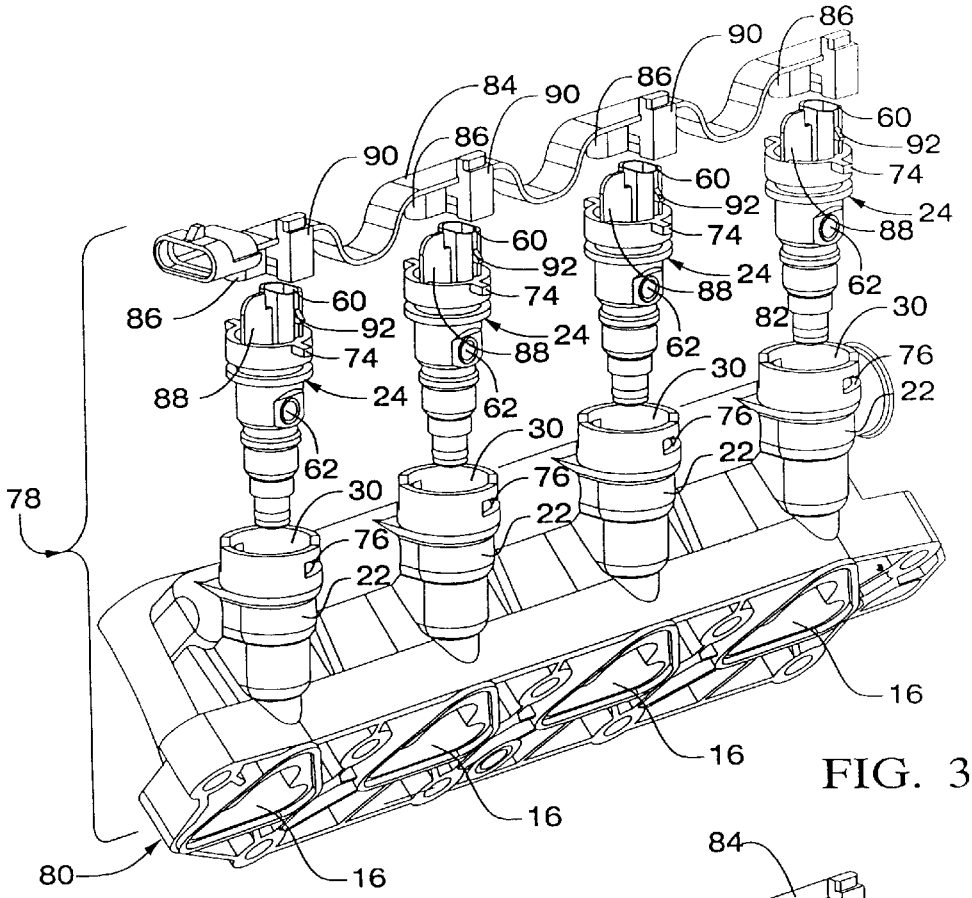
FIG. 3 is an exploded pictorial view of an alternative embodiment of manifold assembly utilizing twist lock injector retention.
Figure 4:
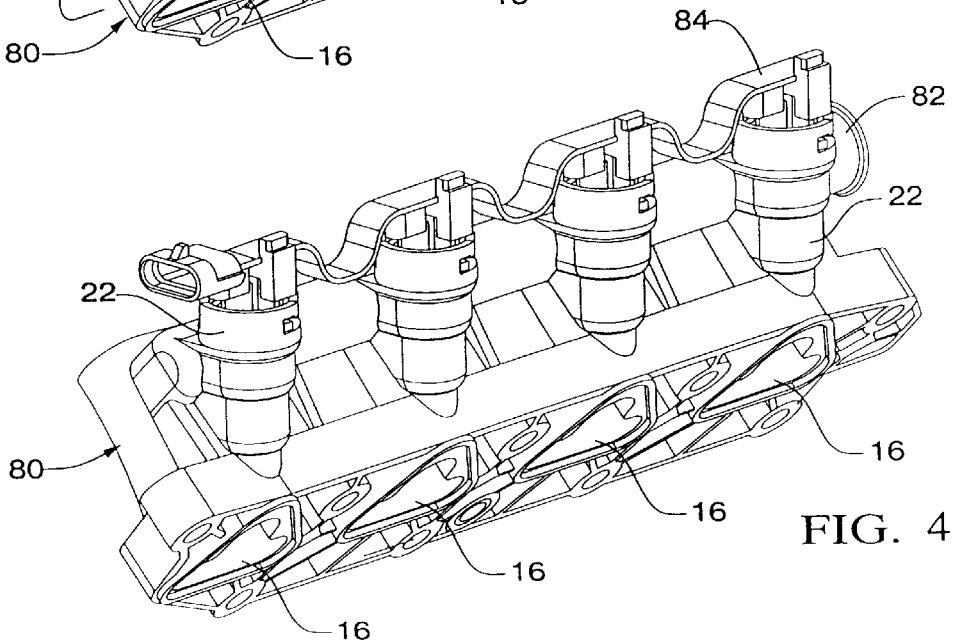
FIG. 4 is a pictorial view showing the embodiment of FIG. 3 as assembled.
Figure 5:
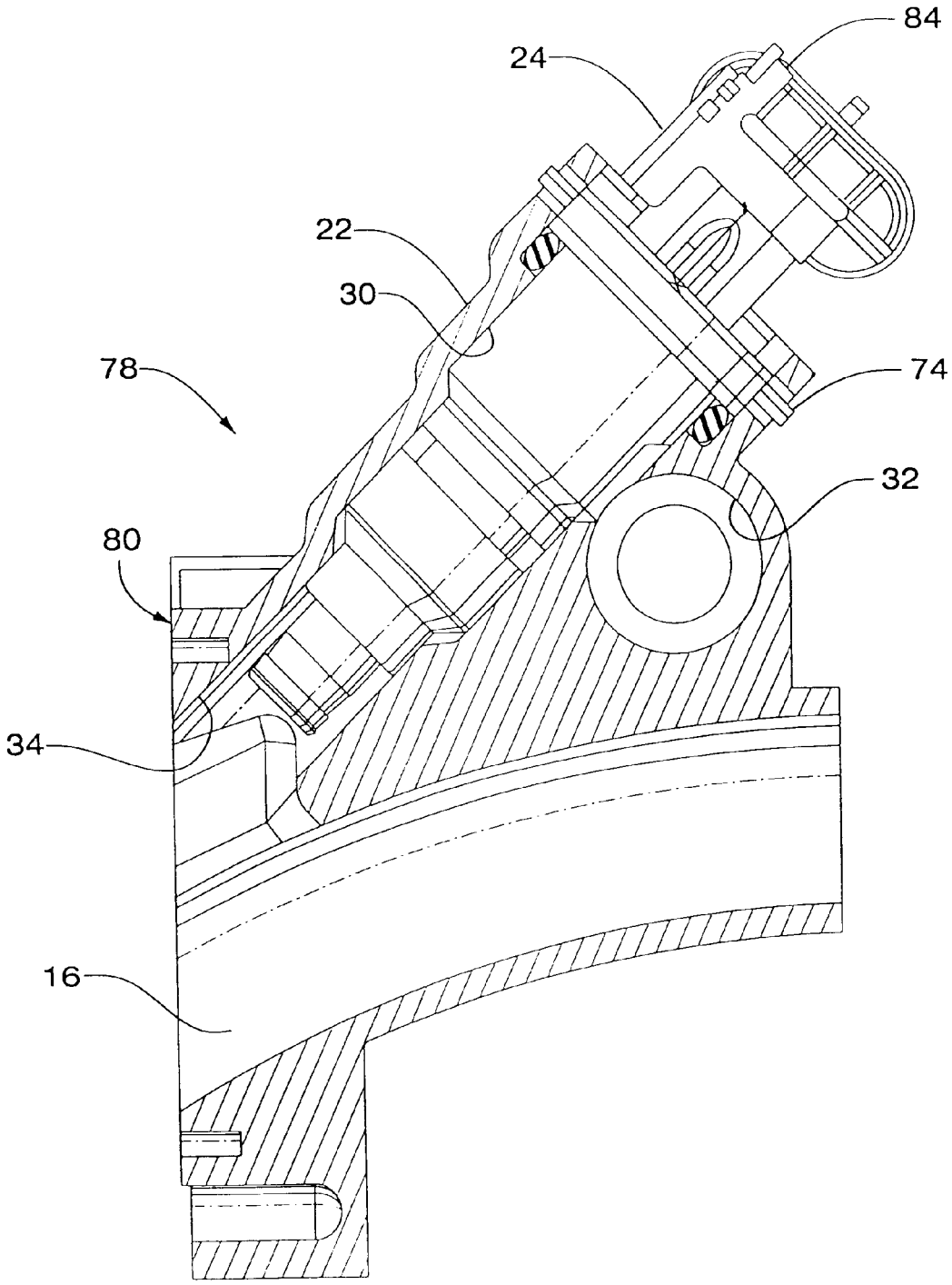
FIG. 5 is a cross-sectional view showing mounting of a side 5 feed fuel injector within the manifold of FIG. 4.

Referring now to FIGS. 3–5, there is shown a second embodiment of a manifold assembly of the present invention. Manifold assembly 78 includes a manifold 80 having a connecting portion 82 (FIG. 4) that internally defines a common fuel passage 32 (FIG. 5). Passage 32 is integral with manifold 80, and extends longitudinally therein to 15 connect internally with injector pockets 30 formed within the pods 22. Side feed fuel injectors 24 are mounted in each of the pockets 30, as described above, with the side feed openings 62 positioned to communicate with the common fuel passage 32. A single piece semi-flexible fuel injector connector 84 is electrically connected to each of the connector sockets 60. More particularly, each of slotted guides 86 engage a corresponding blade 88 of injectors 24 to assure proper orientation, and latch devices 90 engage retainers 92 to maintain the connector elements in assembly with the injectors until released. Lugs 74 engage the L-shaped slots 76 at the second, or outer, ends of injector pockets 30 and retain injectors 24 in place with a twist lock connection in assembly, as shown in FIG. 4. Injectors 24 operate to spray fuel into the air intake passages 16 shown through the mounting face of the manifold 80.

As shown in FIG. 5, the air intake passages 16 connect with the bottom or one end 34 of the injector pockets 30. Injectors 24 are fed with fuel by the common integral fuel passage 32.

Figure 6:
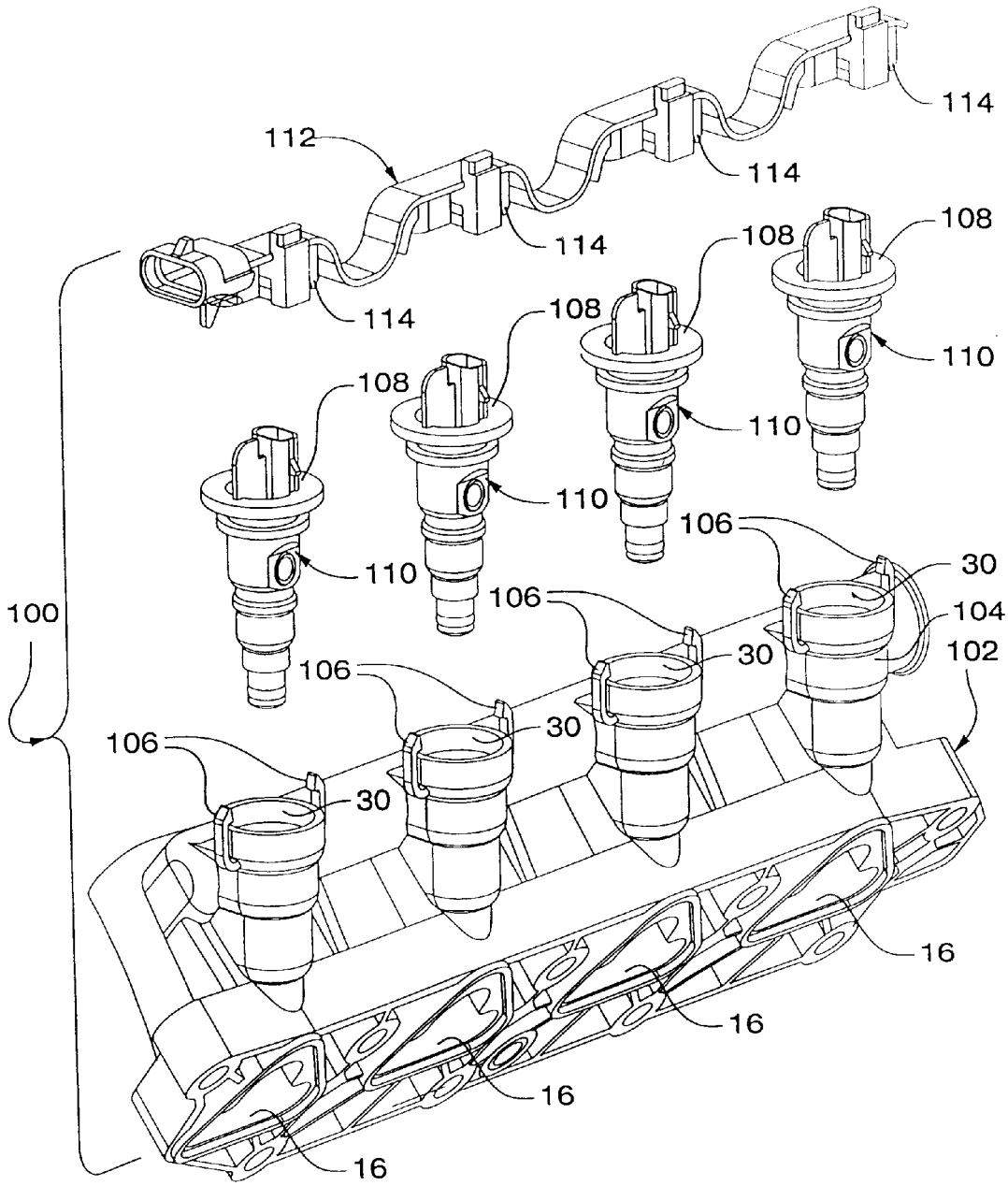
FIG. 6 is an exploded pictorial view illustrating a manifold assembly with snap-in injectors.

FIG. 6 illustrates another embodiment of a manifold assembly of the present invention. Manifold assembly 100 is generally similar to the embodiment of FIGS. 3–5, and therefore only the distinctions are discussed in detail below. The L-shaped retainer openings 76 of pockets 30 in manifold assembly 78 have been replaced in manifold assembly 100. More particularly, manifold assembly 100 includes manifold 102 having pods 104. Pods 104 include resilient fingers 106 with hook ends that are engagable with cooperating edges 108 of associated side feed fuel injectors 110. A modified fuel injector connector 112 includes downwardly angled protrusions 114 which, in assembly, engage outer surfaces of the fingers 106 to prevent the hook ends from releasing the injectors while the connector 112 is installed.

Figure 7:
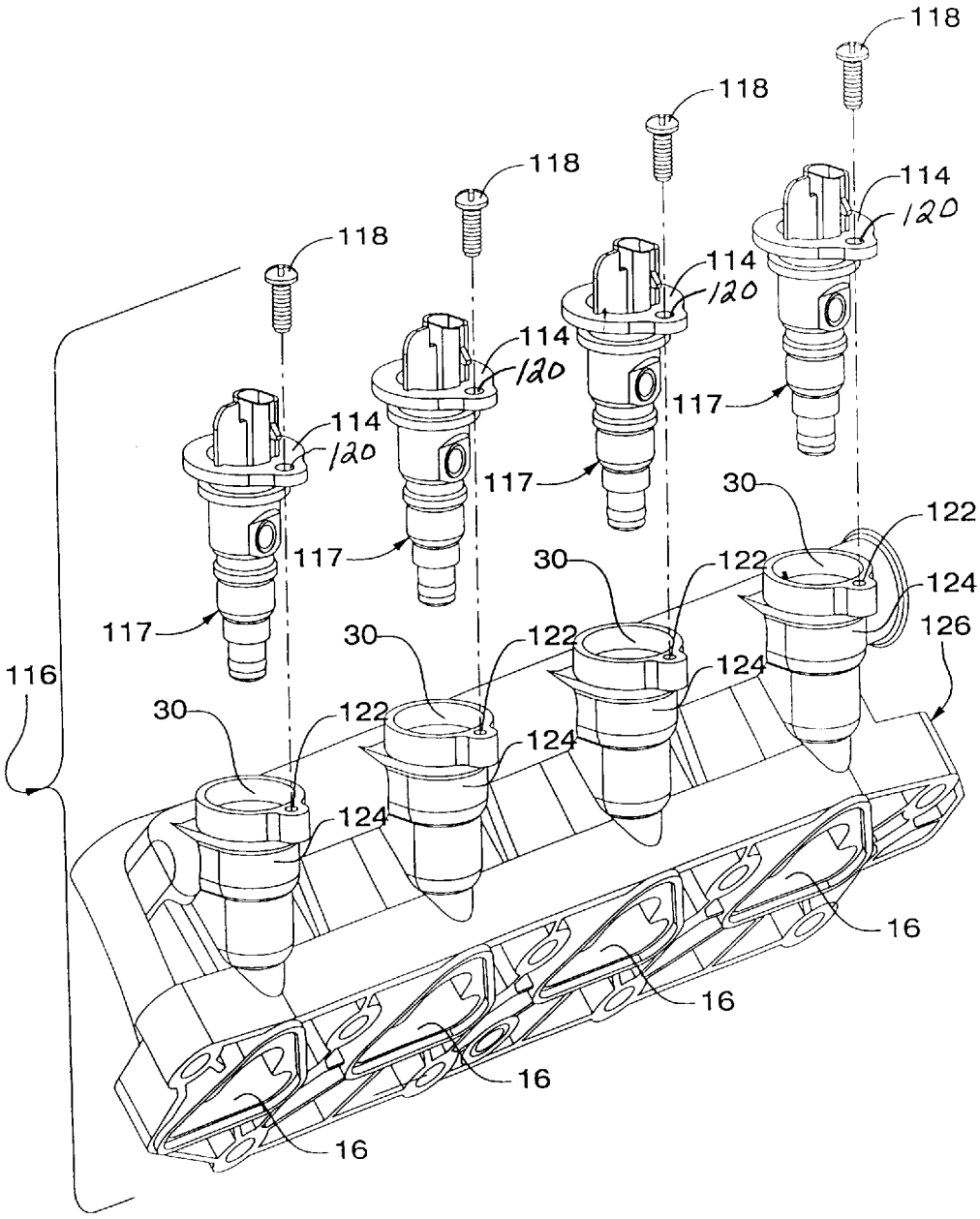
FIG. 7 is an exploded pictorial view illustrating a manifold assembly with screw attached injectors.

FIG. 7 illustrates yet another embodiment of a manifold assembly of the present invention. Manifold assembly 116 which is similar to the embodiment of FIGS. 3–5, and differs only in the manner of retaining the injectors 117. In FIG. 7, the injectors 117 are retained by screws 118 that pass through tang openings 120 and engage threaded openings 122 in the ends of the injector receiving pods 124 of the manifold 26.

Figure 8:
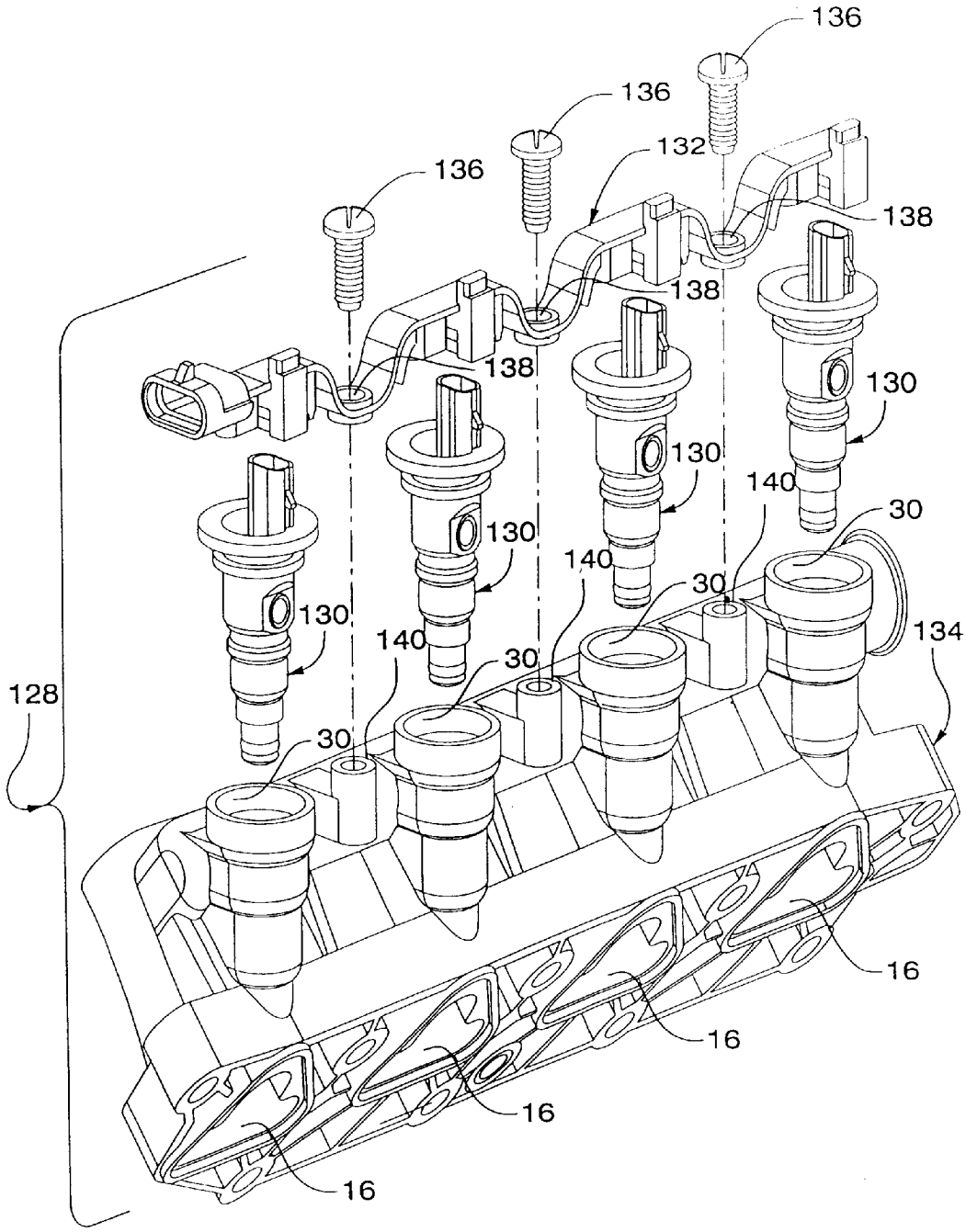
FIG. 8 is an exploded pictorial view showing a manifold assembly with injectors retained by a semi-flexible fuel injector connector.

FIG. 8 illustrates a still further embodiment of a manifold assembly of the present invention. Manifold assembly 128 retains injectors 130 by a common connector 132. The connector 132 is held to the manifold 134 by screws 136 which extend through openings 138 in the connector to engage threaded bosses 140 in the manifold body.

Figure 9:
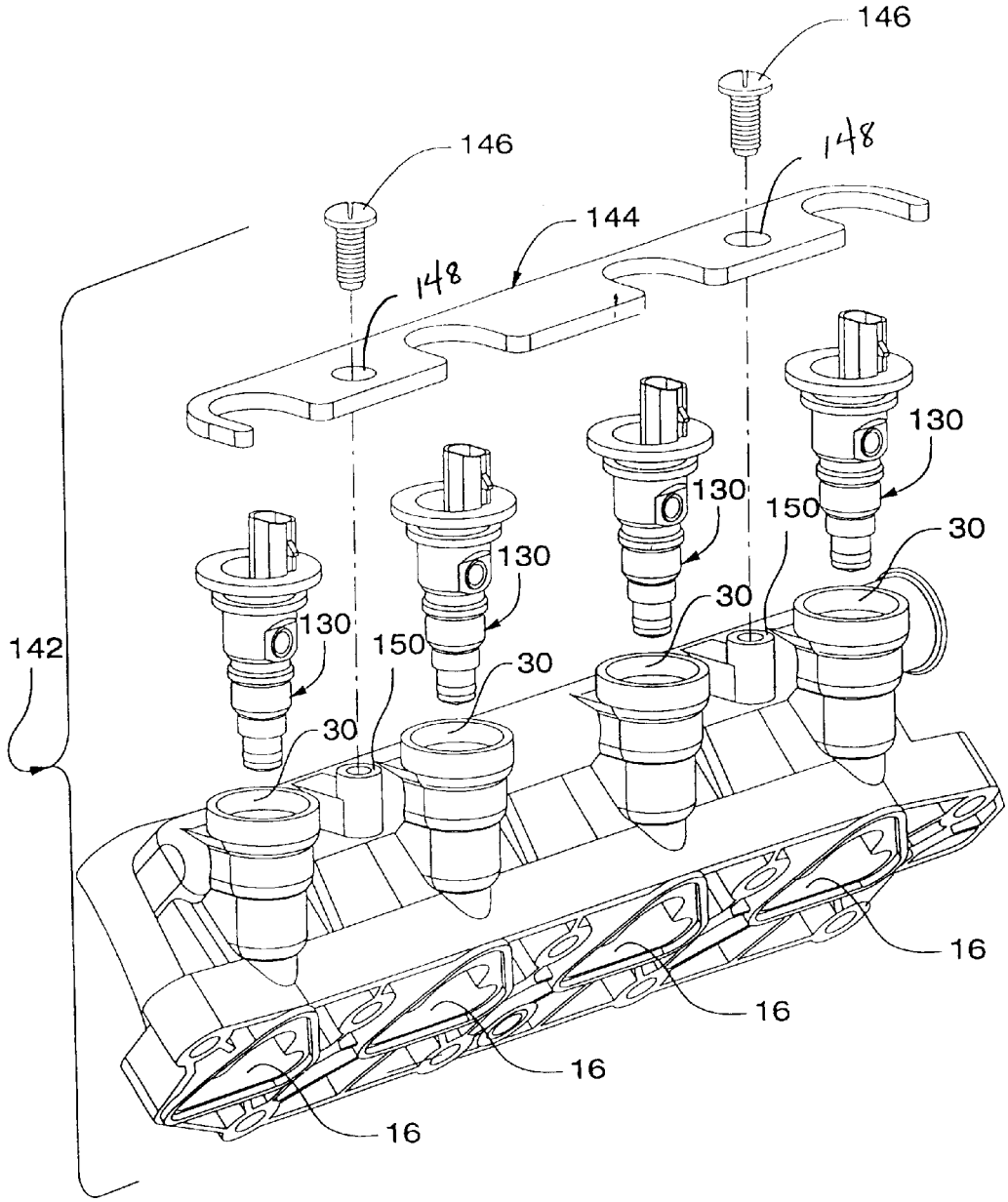
FIG. 9 is an exploded pictorial view showing a manifold assembly with injectors retained by a screw attached retaining plate.

FIG. 9 shows an even further embodiment of a manifold assembly of the present invention. Manifold assembly 142 retains the injectors 130 by a retainer bar 144.that is secured against the ends of the injectors 130 by screws 146 that pass through openings 148 in bar 144 and engage threaded bosses 150 of the manifold 152.

To summarize, FIGS. 3 through 9 show various similar forms of manifold assemblies which primarily differ in the manner in which the side feed injectors of the assemblies are retained in the injector pockets 30 of each of the manifolds of the various assemblies.

While the invention has been described by reference to certain preferred embodiments, it should be understood that numerous changes could be made within the spirit and scope of the inventive concepts described.

Accordingly it is intended that the invention not be limited to the disclosed embodiments, but that it have the full scope permitted by the language of the following claims.

What is claimed is:

1. A fuel injector, comprising:

a body having a nozzle end and a connector end, said body defining a side feed opening disposed between said nozzle end and said connector end;

an injection assembly disposed in said nozzle end, said injection assembly including an actuating coil, a valve actuated by said coil, and a valve seat operably associated with said valve.

2. The fuel injector of claim 1, wherein said injection assembly defines a fuel passageway, said fuel passageway fluidly connecting said side feed opening and said valve.

3. The fuel injector of claim 2, further comprising a connecting tube, said connecting tube fluidly connecting said side feed opening and said fuel passageway.

4. The fuel injector of claim 2, wherein said injection assembly further comprises a spring disposed within said fuel passageway, said spring engaging said valve and biasing said valve against said valve seat.

5. The fuel injector of claim 4, wherein said injection assembly further comprises an adjusting tube, said adjusting tube disposed at least partially within said fuel passageway, said adjusting tube applying a predetermined pre-load force to said spring.

6. The fuel injector of claim 5, wherein said adjusting tube includes a first adjusting tube end and a second adjusting tube end, said spring includes a first spring end and a second spring end, said first adjusting tube end associated with said connecting tube, said second adjusting tube end engaging said first spring end, said second spring end engaging said valve.

7. The fuel injector of claim 2, wherein said fuel passageway is substantially axially-centered relative to said body.

8. The fuel injector of claim 2, wherein said fuel passageway extends through and is substantially axially-centered relative to said coil.

9. The fuel injector of claim 8, wherein at least a portion of a length of said fuel passageway is radially surrounded by an armature of said coil.

10. The fuel injector of claim 1, wherein said connector end includes an electrical connector electrically connected to said coil, said electrical connector configured for being connected to a source of electrical power for actuating said coil.

11. A manifold assembly comprising:

an engine intake manifold, including:

a plurality of air intake passages configured for being disposed in fluid communication with associated engine cylinder inlet ports;

a plurality of injector pockets, each of said plurality of injector pockets having a respective first end and a respective open end, each said first end being in fluid communication with a corresponding one of said plurality of air intake passages; and a manifold fuel passage integral with said manifold, said manifold fuel passage in fluid communication with said plurality of injector pockets proximate said open ends thereof, said manifold fuel passage configured for carrying fuel to each of said plurality of injector pockets; and a fuel injector disposed in each of said plurality of injector pockets, each said fuel injector including:

a body having a nozzle end and a connector end, said body defining a side feed opening disposed between said nozzle end and said connector end, said side feed opening in fluid communication with said manifold fuel passage; and an injection assembly disposed in said nozzle end, said injection assembly including an actuating coil, a valve actuated by said coil, and a valve seat operably associated with said valve.

12. The manifold assembly of claim 11, wherein said injection assembly defines an injector fuel passageway, said injector fuel passageway fluidly connecting said side feed opening and said valve.

13. The manifold assembly of claim 12, wherein said fuel injector further comprises a connecting tube, said connecting tube fluidly connecting said side feed opening and said injector fuel passageway.

14. The manifold assembly of claim 12, wherein said injection assembly further comprises a spring disposed within said injector fuel passageway, said spring engaging said valve and biasing said valve against said valve seat.

15. The manifold assembly of claim 14, wherein said injection assembly further comprises an adjusting tube, said adjusting tube disposed at least partially within said injector fuel passageway, said adjusting tube applying a predetermined pre-load force to said spring.

16. The manifold assembly of claim 15, wherein said adjusting tube includes a first adjusting tube end and a second adjusting tube end, said spring includes a first spring end and a second spring end, said first adjusting tube end associated with said connecting tube, said second adjusting tube end engaging said first spring end, said second spring end engaging said valve.

17. The manifold assembly of claim 12, wherein said injector fuel passageway is substantially axially-centered relative to said body of said fuel injector.

18. The manifold assembly of claim 12, wherein said injector fuel passageway is substantially axially-centered relative to said coil.

19. The manifold assembly of claim 12, wherein at least a portion of a length of said injector fuel passageway is radially surrounded by said coil.

20. The manifold assembly of claim 11, further comprising retaining means retaining said injectors within said injector pockets.

* * * * *